US009234399B2

(12) United States Patent
Pearce et al.

(10) Patent No.: US 9,234,399 B2
(45) **Date of Patent: *Jan. 12, 2016**

(54) IMPREGNATED DRILL BITS WITH INTEGRATED REAMERS

(71) Applicant: LONGYEAR TM, INC., South Jordan, UT (US)

(72) Inventors: Cody A. Pearce, Midvale, UT (US); Michael D. Rupp, Murray, UT (US); Christian M. Lambert, Draper, UT (US)

(73) Assignee: Longyear TM, Inc., South Jordan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/669,897

(22) Filed: Mar. 26, 2015

(65) Prior Publication Data

US 2015/0197999 A1 Jul. 16, 2015

Related U.S. Application Data

(63) Continuation of application No. 13/177,427, filed on Jul. 6, 2011, now Pat. No. 8,991,524.

(60) Provisional application No. 61/382,112, filed on Sep. 13, 2010.

(51) Int. Cl.

| | |
|---|---|
| ***E21B 10/02*** | (2006.01) |
| ***E21B 10/48*** | (2006.01) |
| ***E21B 25/16*** | (2006.01) |
| ***E21B 10/18*** | (2006.01) |

(Continued)

(52) U.S. Cl.

CPC ..... *E21B 25/16* (2013.01); *E21B 10/02* (2013.01); *E21B 10/18* (2013.01); *E21B 10/26* (2013.01); *E21B 10/48* (2013.01); *E21B 17/1092* (2013.01)

(58) Field of Classification Search

CPC ..... E21B 10/48; E21B 10/02

See application file for complete search history.

(56) References Cited

U.S. PATENT DOCUMENTS

| | | | | |
|---|---|---|---|---|
| 1,907,154 | A | 5/1933 | Mitchell | |
| 2,419,901 | A * | 4/1947 | Lake | 175/405.1 |
| 2,708,104 | A | 5/1955 | Cameron | |

(Continued)

FOREIGN PATENT DOCUMENTS

| | | | |
|---|---|---|---|
| AU | 2011302487 | A1 | 2/2013 |
| CA | 1053938 | A1 | 5/1979 |

(Continued)

OTHER PUBLICATIONS

Longyear Europe, Diamond Products Sales Manual, May 26, 1993, pp. 1-3, T-21, 4-1-6.

(Continued)

*Primary Examiner* — Giovanna C Wright

(74) *Attorney, Agent, or Firm* — Ballard Spahr LLP

(57) ABSTRACT

Drilling tools include a bit crown and an integrated reamer. The bit crown and integrated reamer can be configured with approximately equal drilling lives. The bit crown can be impregnated with abrasive cutting media and include one or more external flutes. The integrated reamer can be positioned at the base the bit crown and include one or more channels that align with one or more of the outer flutes. The channels can taper such that they increase in width as they extend away from the bit crown.

26 Claims, 7 Drawing Sheets

(51) Int. Cl.

| | |
|---|---|
| ***E21B 17/10*** | (2006.01) |
| ***E21B 10/26*** | (2006.01) |

(56) References Cited

U.S. PATENT DOCUMENTS

| | | | | |
|---|---|---|---|---|
| 2,738,167 | A | 3/1956 | Williams | |
| 3,712,392 | A * | 1/1973 | Gorgendiere | E21B 7/10 175/215 |
| 3,736,995 | A * | 6/1973 | Salter | B28D 1/041 175/387 |
| 3,833,077 | A | 9/1974 | Lavallee | |
| 3,930,679 | A | 1/1976 | Anderson et al. | |
| 4,971,158 | A | 11/1990 | Salmi | |
| 5,253,939 | A * | 10/1993 | Hall | 384/303 |
| 5,366,032 | A | 11/1994 | Kay | |
| 6,263,985 | B1 | 7/2001 | Scheid et al. | |
| 6,926,099 | B2 | 8/2005 | Thigpen et al. | |
| 7,628,228 | B2 | 12/2009 | Drivdahl et al. | |
| 7,695,185 | B1 | 4/2010 | McClain et al. | |
| 8,991,524 | B2 * | 3/2015 | Pearce et al. | 175/403 |
| 2004/0188149 | A1 | 9/2004 | Thigpen et al. | |
| 2006/0162967 | A1 | 7/2006 | Brackin et al. | |
| 2007/0119624 | A1 | 5/2007 | Brady | |
| 2007/0119625 | A1 | 5/2007 | Brady | |
| 2008/0000692 | A1 | 1/2008 | Roussy | |
| 2008/0128170 | A1 | 6/2008 | Drivdahl et al. | |
| 2008/0135306 | A1 | 6/2008 | Da Silva et al. | |
| 2008/0142262 | A1 | 6/2008 | Drivdahl et al. | |
| 2010/0089660 | A1 | 4/2010 | Pearce et al. | |
| 2011/0036640 | A1 | 2/2011 | Lambert et al. | |

FOREIGN PATENT DOCUMENTS

| | | | |
|---|---|---|---|
| CA | 2808594 | A1 | 3/2012 |
| CN | 101128644 | A | 2/2008 |
| JP | 2001-123783 | A | 5/2001 |
| WO | WO-2007/065099 | A2 | 6/2007 |
| WO | WO-2012/036849 | A2 | 3/2012 |
| ZA | 2013/01856 | | 5/2014 |

OTHER PUBLICATIONS

Boart Longyear Company, Core Bit, Aug. 30, 2005, Salt Lake City, Utah.

Boart Longyear Company, Longyear Bits and Accessories, Global Product Catalogue, Aug. 2009, pp. 1' 3-7, 13-30, 121-124, 147-150, Salt Lake City, Utah.

Non-Final Office Action issued by the U.S. Patent & Trademark Office on May 20, 2014 for U.S. Appl. No. 13/177,427, filed Jul. 6, 2011 and granted as U.S. Pat. No. 8,991,524 on Mar. 31, 2015 (Applicant—Boart Longyear // Inventor—Pearce, et al.) (14 pages).

Amendment and Response to Non-Final Office Action filed bon Aug. 20, 2014 for U.S. Appl. No. 13/177,427, filed Jul. 6, 2011 and granted as U.S. Pat. No. 8,991,524 on Mar. 31, 2015 (Applicant—Boart Longyear // Inventor—Pearce, et al.) (13 pages).

Final Office Action issued by the U.S. Patent & Trademark Office on Aug. 28, 2014 for U.S. Appl. No. 13/177,427, filed Jul. 6, 2011 and granted as U.S. Pat. No. 8,991,524 on Mar. 31, 2015 (Applicant—Boart Longyear // Inventor—Pearce, et al.) (13 pages).

Amendment and Response to Final Office Action filed on Nov. 24, 2014 for U.S. Appl. No. 13/177,427, filed Jul. 6, 2011 and granted as U.S. Pat. No. 8,991,524 on Mar. 31, 2015 (Applicant—Boart Longyear // Inventor—Pearce, et al.) (13 pages).

Notice of Allowance and Fees Due issued by the U.S. Patent & Trademark Office on Dec. 5, 2014 for U.S. Appl. No. 13/177,427, filed Jul. 6, 2011 and granted as U.S. Pat. No. 8,991,524 on Mar. 31, 2015 (Applicant—Boart Longyear // Inventor—Pearce, et al.) (5 pages).

International Search Report issued by the International Searching Authority on May 11, 2012 for international application PCT/US2011/048682, filed on Aug. 22, 2011, and published as WO 2012/036849 on Mar. 22, 2012 (Applicant—Boart Longyear // Inventor—Pearce, et al.) (4 pages).

International Preliminary Report on Patentability and Written Opinion issued by the International Searching Authority on Mar. 19, 2013 for international application PCT/US2011/048682, filed on Aug. 22, 2011, and published as WO 2012/036849 on Mar. 22, 2012 (Applicant—Boart Longyear // Inventor—Pearce, et al.) (10 pages).

* cited by examiner

IMPREGNATED DRILL BITS WITH INTEGRATED REAMERS

CROSS-REFERENCE TO RELATED APPLICATIONS

This application is a continuation of U.S. patent application Ser. No. 13/177,427, filed Jul. 6, 2011, now U.S. Pat. No. 8,991,524, entitled "Impregnated Drill Bits with Integrated Reamers" and claims priority to and the benefit of U.S. Provisional Application No. 61/382,112, filed Sep. 13, 2010. The contents of the above-referenced patent applications are hereby incorporated by reference in their entirety.

BACKGROUND

Field of the Invention

This application relates generally to drilling methods and devices used in drilling. In particular, this application relates to drill bits having integrated reamers and to method of making and using such drill bits.

Core drilling (or core sampling) includes obtaining samples of formations at various depths for various reasons. For example, a retrieved core sample can indicate what materials, such as petroleum, precious metals, and other desirable materials, are present or are likely to be present in a particular formation, and at what depths. In some cases, core sampling can give a geological timeline of materials and events. As such, core sampling can help determine the desirability of further exploration in a particular area.

Wireline drilling systems are one common type of drilling system for retrieving a core sample. In a wireline drilling process, a core drill bit is attached to the leading edge of an outer tube or drill rod. A drill string is then formed by attaching a series of drill rods that are assembled together section by section as the outer tube is lowered deeper into the desired formation. A core barrel assembly is then lowered or pumped into the drill string. The core drill bit is rotated, pushed, and/or vibrated into the formation, thereby causing a sample of the desired material to enter into the core barrel assembly. Once the core sample is obtained, the core barrel assembly is retrieved from the drill string using a wireline. The core sample can then be removed from the core barrel assembly.

Impregnated drill bits are commonly used for core sampling operations and other drilling operations, particularly in very hard or abrasive rock formations. Impregnated drill bits typically contain natural or synthetic diamonds distributed within a supporting matrix to form a crown or cutting section. During operation of the drill bit, diamonds within the crown are gradually exposed as the supporting matrix is worn away so the cutting surface remains sharp. Impregnated drill bits may continue to cut efficiently until the diamond crown or cutting section of the tool is consumed. Once consumed, the drill bit becomes dull and typically requires replacement.

Coupling reamers or reaming shells are often used to attach a core drill bit to the distal end of a core barrel. Typically, a reamer is secured between the distal end of a core barrel and the core drill bit. Reamers can help maintain a desired diameter of the borehole by removing loose or uneven material from the walls of the borehole. Reamers also can help maintain drill string alignment in the borehole as the reamers typically have an outer diameter similar to the inner diameter of the borehole. Some conventional reamers are generally made using a tube that can be placed in line with the drill string. The tube may have abrasive pads or rings extending around the steel tube to achieve a desired stability for the drill string and/or to maintain the diameter of the borehole.

During drilling operations drill bits and reamers can become damaged or consumed through use. Replacement of damaged or consumed drill bits and/or reamers may be time consuming, costly, as well as dangerous. For example, the replacement of drill bits and reamers typically requires removing (or tripping) the entire drill string out of a borehole. Each section of the drill string must be sequentially removed from the borehole. Once the drill bit or reamer is replaced, the entire drill string must be assembled section by section and then tripped back into the borehole. Depending on the depth of the borehole and the characteristics of the materials being drilled, this process may need to be repeated multiple times for a single borehole.

Furthermore, conventional reamers typically last two to five times as long as conventional core drill bits. Thus, often a drill string will have to be tripped to replace a drill bit. Furthermore, replacing a reamer that couples a drill bit to a drill string when the drill bit is not yet consumed, or replacing the drill bit when the coupling reamer is not yet consumed, can require making and breaking of joints between the drill bit and the reamer, which can be time consuming, difficult, and potentially dangerous.

Conventional reamers that couple to bits have portions (e.g., blanks or gaps) without pads or crowns due to their separate construction. These blanks or gaps have reduced flow velocity. Debris can tend to collect in these low velocity regions and can cut off the reamer or bit shank. If this occurs, the reamer or bit may not be able to be retrieved from the hole without special measures, which typically are very time consuming. Usually, the special measure entails drilling through the bit and/or reamer. Occasionally, the material cannot be drilled out and the driller needs to divert the hole at significant cost and time.

When a bit is replaced, typically the reamer will be examined. In some cases, the reamer wears out prior to completion of the bit and cannot be detected by the driller. If this occurs, the drill string may not advance when a new bit and reamer are installed. Due to the larger size of the new bit and or reamer, the hole must typically be re-drilled to increase its diameter for the depth during which a worn reamer was used. This is referred to as reaming down the hole.

Conventional reamer and bit construction use a threaded joint between these two components and the distal end of the rod string. This joint can have reduced stiffness, which in turn reduces the directional stability of the distal end of the rod string. The joint also can introduce concentricity error between the bit and reamer. The concentricity error can produce bending causing vibration and decreasing the directional stability of the drill string.

In broken conditions, hard facing is often added to increase the life of the bit blank and bit reamer. The hard-facing prevents wear in the low velocity zones. Adding of hard facing presents a significant cost in the manufacture of the bits and reamers.

Accordingly, there are a number of disadvantages in conventional reamers and drill bits that can be addressed.

SUMMARY

Implementations of the present invention overcome one or more problems in the art with drilling tools, systems, and methods that can provide for reduced tripping of a drill string to replace parts. For example, one or more implementations of the present invention include drilling tools with a drill bit and an integrated reamer. Such unitary drilling tools can increase drilling efficiency and speed, while also increasing safety for drilling operators.

For example, one implementation of a drilling tool can include a unitary shank having a first end and an opposing second end. The drilling tool can also include a connector on the first end of the shank for securing the shank to a drill string component. Also, a bit crown can be secured to the second end of the shank and a reamer can be secured on the shank.

Additionally, an implementation of a core drilling system can include a drill string and a drilling tool secured to a distal end of the drill string. The drilling tool can include a unitary shank having a first end and a second opposing end. The first end of the shank can be secured to the distal end of the drill string. An annular bit crown can be secured to the second end of the shank. Furthermore, a reamer can be secured to the shank between the first and second ends of the shank.

In addition to the foregoing, a method of core drilling in accordance with an implementation of the present invention can involve securing a first end of a unitary drilling tool to a drill string. The method can also involve advancing the drill string into a formation. Upon advancement of the drill string into the formation, a bit crown on the second end of the unitary drilling tool can cut a hole into the formation. Additionally, a reamer on the unitary drilling tool can maintain a diameter of the hole. The method can further involve tripping the drill string from the formation and removing the unitary drilling tool from the drill string by breaking a single joint between the first end of the unitary drilling tool and the drill string.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

One or more implementations of the present invention are directed toward drilling tools, systems, and methods that can provide for reduced tripping of a drill string to replace parts. For example, one or more implementations of the present invention include drilling tools with a drill bit and an integrated reamer. Such unitary drilling tools can increase drilling efficiency and speed, while also increasing safety for drilling operators.

In addition to the foregoing, an impregnated drill bit and integrated reamer of a drilling tool of one or more implementations of the present invention can be configured with approximately equal drilling lives. The approximately equal cutting lives can cause the bit crown and reamer to be consumed at approximately the same time. Thus, allowing a drilling operator to replace both the bit crown and reamer at the same time.

Furthermore, a drilling operator can replace the impregnated crown and integrated reamer by breaking and making a single joint between the drilling tool and the drill string. One will appreciate that this is in contrast to conventional reamers, which require breaking and making a first joint between the reamer and the drill string and a second joint between the reamer and the drill bit. Thus, the impregnated drill bits with integrated reamers of one or more implementations can allow for reduced tripping of the drill string and reduced breaking and making of joints. As such, one or more implementations of the present invention can reduce drilling time and expense, while at the same time increasing safety.

Figure 1:
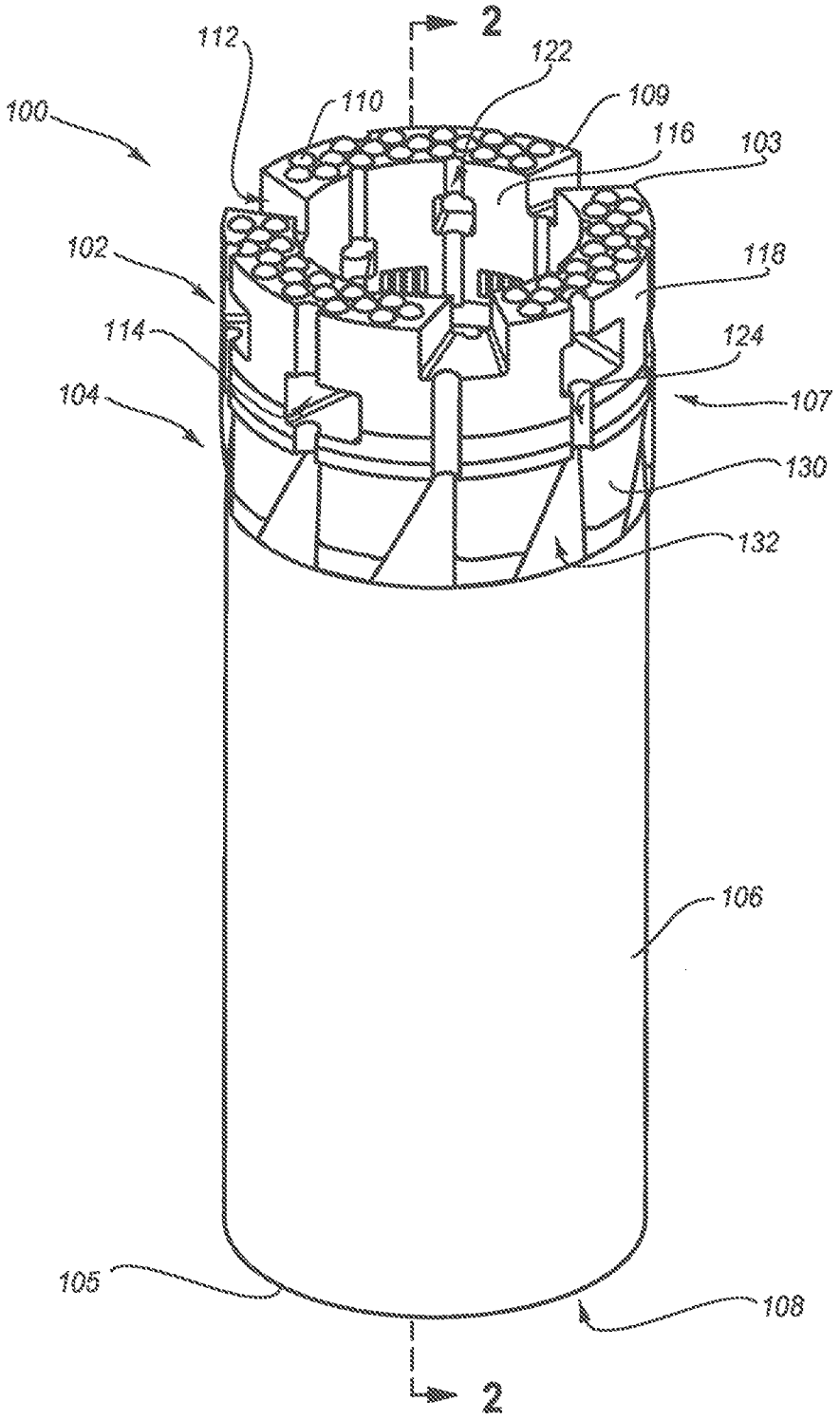
FIG. 1 illustrates a perspective view of a core drilling tool including an impregnated crown and an integrated reamer in accordance with an implementation of the present invention.
Figure 2:
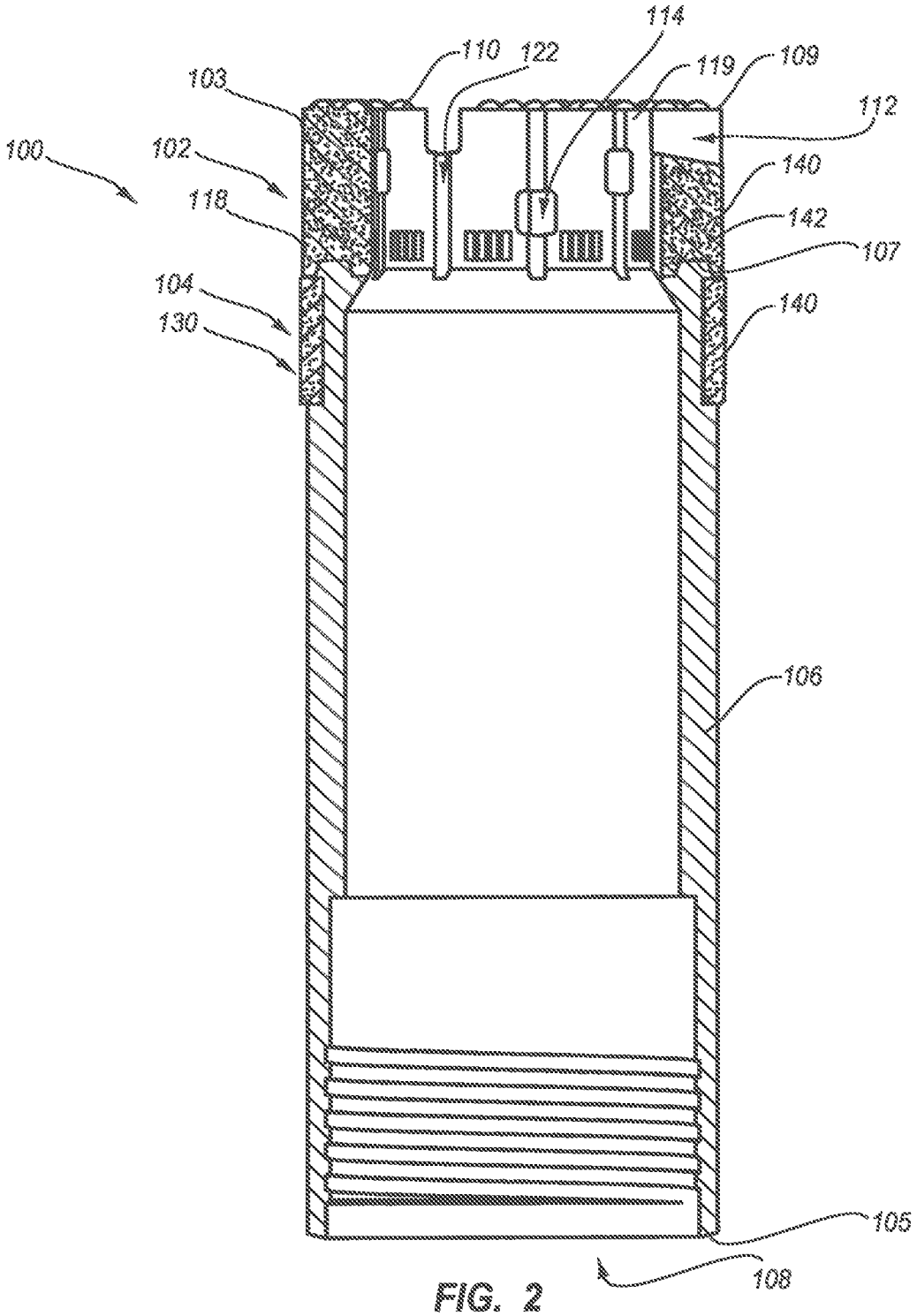
FIG. 2 illustrates a cross-sectional view of the core drilling tool of FIG. 1 taken along the line 2-2 of FIG. 1.

For example, FIGS. 1 and 2 illustrate a perspective view and a side cross-sectional view of a drilling tool 100 including an impregnated drill bit 102 and an integrated reamer 104. As shown by FIGS. 1 and 2, the drilling tool 100 can include a bit crown or cutting section 103, a reamer 104, a shank 106, and a connector 108. In particular, the drilling tool 100 can comprise a single or unitary structure (i.e., the reamer 104 and the drill bit 102 are attached directly a unitary shank 106). In other words, the drilling tool 100 can comprise a shank 106 with a connector 108 at a first end 105, and a bit crown 103 secured to the opposing, second end 107. Additionally, a reamer 104 can be positioned along the shank 106 between the connector 108 and the bit crown 103, or in other words between the first end 105 and the second end 107 of the shank 106.

FIG. 2 illustrates that the reamer 104 and drill bit 102 are two separate pieces. In alternative implementations, the reamer 104 and drill bit 102 can comprise a single component infiltrated as one piece.

As alluded to earlier, the bit crown 103 and the reamer 104 can be configured with approximately equal cutting lives. For example, the bit crown 103 can be configured with an extended height such that the bit crown 103 and reamer 104 will require replacement at approximately the same time. In particular, the bit crown 103 can include one or more rows of offset enclosed fluid slots 114 that allow for an increased height and prolonged drilling life approximately equal to that of the reamer 104. Alternatively, or additionally, the composition of the bit crown 103 can be tailored to provide desired strength characteristics (i.e., erosion rate due to an increased or decreased matrix strength) such that the bit crown 103 has a drilling life approximately equal to the drilling life of the reamer 104. In particular, the drilling life of the reamer 104 can be equal to or greater than the bit crown life 103, which can prevent reaming back down hole. Furthermore, this can be beneficial as often the driller may only recognize when the bit crown 103 is at the end of its useful life and not when the reamer 104 is at the end of its useful life.

One will appreciate in light of the disclosure herein that a drilling tool 100 with a bit crown 103 and reamer 104 configured with approximately equal cutting lives can provide a number of benefits. For example, the drilling tool 100 need only be tripped from a borehole a single time to change both the drill bit 102 or bit crown 103 and the reamer 104. In other words, a user need not have to trip a drill string to replace the drill bit, and then trip the drill string another time to replace the reamer. The reduction in tripping of the drill string can increase drilling efficiency and safety, and decrease drilling time and costs. In addition to the foregoing, only a single joint need be broken to replace both the bit crown 103 and the reamer 104.

In one or more implementations, the drilling tool 100 can have an increased length. In particular, the drilling tool 100 can have a length approximately equal to a conventional drill bit and reaming shell. Thus, the drilling tool 100 can replace a conventional drill bit and reaming shell. For example, as shown by FIG. 2 in one or more implementations the total length of the drilling tool 100 can be approximately 6 times the height of the bit crown 103. In alternative implementations, the total length of the drilling tool 100 can be approximately 3, 4, 5, or more than 6 times the height of the bit crown 103.

One will appreciate that the integrated reamer 104 can provide the drilling tool 100 with increased strength and durability by eliminating a threaded connection between the drill bit 102 and the reamer 104. Additionally, the drilling tool 100 can reduce the stocking and shipping requirements for manufacturers and end users as the drilling tool 100 can replace both a conventional drill bit and conventional reamer. Thus, the drilling tool 100 can decrease operating costs. Also the drilling tool 100 can reduce manufacturing costs by eliminating a separate reamer and the associated two threading operations and a furnacing operation.

Furthermore, the drilling tool 100 including an impregnated drill bit 102 and an integrated reamer 104 can also increase safety. For example, often the joint between a drill bit and reaming shell is the tightest in the drill string. Thus, breaking this joint can be time consuming and dangerous due to the forces need to break the joint. Thus, by eliminating the joint between the drill bit 102 and reamer 104, the drilling tool 100 can eliminate hazards associated with breaking such a joint.

FIGS. 1 and 2 further illustrate that in one or more implementations the reamer 104 can be positioned on the shank 106 directly behind the bit crown 103. One will appreciate in light of the disclosure herein that the position of the reamer 104 directly behind the bit crown 103 can provide a number of benefits. For example, the position of the reamer 104 directly behind the bit crown 103 can reduce hole deviation and allow for drilling of straighter holes, and otherwise help maintain the bit crown 103 on an intended drilling path. Thus, the drilling tool 100 can increase drilling efficiency and production by reducing or eliminating the need for borehole measurement and correction.

Additionally, the position of the reamer 104 directly behind the bit crown 103 can reduce or eliminate parting of bit shanks in abrasive/broken conditions and eroding of backing powder in the bit crown 103. Alternatively or additionally, positioning the reamer 104 directly behind the bit 102 can eliminate the use of hard facing that is sometimes applied to try and prevent parting of the blanks Also, the reamer 104 can also reduce vibration of the bit crown 103 while drilling, which can increase drilling efficiency.

In alternative implementations, the reamer 104 may be spaced a distance from the base of the bit crown 103. For example, in one or more implementations the reamer 104 can be positioned adjacent the first end 105 of the drilling tool 100. In still further implementations, the reamer 104 can be positioned approximately at middle of the shank 106 between the first end 105 and the bit crown 103. In additional implementations, the reamer 104 can extend along the entire length of the shank 106 from the bit crown 103 to the first end 105.

A number of the particular features of the bit crown 103 and reamer 104 of FIGS. 1 and 2 will now be described. As an initial matter, the drilling tools described herein can be used to cut stone, subterranean mineral formations, ceramics, asphalt, concrete, and other hard materials. These drilling tools can include, for example, core-sampling drill bits, drag-type drill bits, roller-cone drill bits, reamers, stabilizers, casing or rod shoes, and the like. For ease of description, the Figures and corresponding text included hereafter illustrate examples of impregnated, core-sampling drill bits, and methods of using such drill bits. One will appreciate in light of the disclosure herein; however, that the systems, methods, and apparatus of the present invention can be used with other drilling tools, such as those mentioned hereinabove.

FIGS. 1 and 2 also illustrate that the drilling tool 100 can define an interior space about its central axis for receiving a core sample. Thus, both the shank 106, reamer 104, and bit crown 103 can have a generally annular shape. Accordingly, pieces of the material being drilled can pass through the interior space of the drilling tool 100 and up through an attached drill string. The drilling tool 100 may be any size, and therefore, may be used to collect core samples of any size. While the drilling tool 100 may have any diameter and may be used to remove and collect core samples with any desired diameter, the diameter of the drilling tool 100 can range in some implementations from about 1 inch to about 12 inches. As well, while the kerf of the drilling tool 100 (i.e., the radius of the outer surface 118 minus the radius of the inner surface 116) may be any width, according to some implementations the kerf can range from about ¼ inches to about 6 inches.

The bit crown 103 can be configured to cut or drill the desired materials during the drilling process. In particular, the bit crown 103 of the drilling tool 100 can include a cutting face 109. The cutting face 109 can be configured to drill or cut material as the drilling tool 100 is rotated and advanced into a formation. As shown by FIGS. 1 and 2, in one or more implementations, the cutting face 109 can include a plurality of protrusions 110 extending generally axially away the cutting face 109. The protrusions 110 can help allow for a quick start-up of a new drilling tool 100. In alternative implementations, the cutting face 109 may not include protrusions 110 or may include other features for aiding in the drilling process, such as for example radial grooves.

The cutting face 109 can also include waterways such as fluid notches or fluid slots such as those disclosed in U.S. Pat. Nos. 7,628,288; 7,828,090; 7,918,288; 7,958,954; 7,909,119; 7,874,384 and U.S. Patent Application Publication Nos. 2011-0031027 and 2010-0089660. The contents of each of the above-referenced patents and patent applications are hereby incorporated by reference in their entirety. The waterways may allow drilling fluid or other lubricants to flow across the cutting face 109 to help provide cooling during drilling. For example, FIG. 1 illustrates that the bit crown 103 can include a plurality of notches 112 that extend from the cutting face 109 in a generally axial direction into the bit crown 103 of the tool 100. Additionally, the notches 112 can extend from the inner surface 116 of the bit crown 103 to the outer surface 118 of the bit crown 103. As waterways, the notches 112 can allow drilling fluid to flow from the inner surface 116 of the bit crown 103 to the outer surface 118 of the bit crown 103. Thus, the notches 112 can allow drilling fluid to flush cuttings and debris from the inner surface 116 to the outer surface 118 of the drilling tool 100, and also provide cooling to the cutting face 109.

The bit crown 103 may have any number of notches 112 that provides the desired amount of fluid/debris flow and also allows the bit crown 103 to maintain the structural integrity needed. For example, FIGS. 1 and 2 illustrate that the drilling tool 100 includes three notches 112. One will appreciate in light of the disclosure herein that the present invention is not so limited. In additional implementations, the drilling tool 100 can include as no notches 112, one notch 112, or as many 20 or more notches 112, depending on the desired configuration and the formation to be drilled. Additionally, the notches 112 may be evenly or unevenly spaced around the circumference of the bit crown 103. For example, FIGS. 1 and 2 depicts three notches 112 evenly spaced from each other about the circumference of the bit crown 103. In alternative implementations, however, the notches 112 can be staggered or otherwise not evenly spaced.

In addition to the notches 112, the drilling tool can optionally include a plurality of enclosed slots 114 as previously mentioned. One will appreciate that as the bit crown 103 erodes through drilling, the notches 112 can wear away. As the erosion progresses, the enclosed slots 114 can become exposed at the cutting face 109 and then thus become notches. One will appreciate that the configuration of drilling tool 100 can thus allow the longitudinal dimension of the bit crown 103 to be extended and lengthened without substantially reducing the structural integrity of the drilling tool 100. The extended longitudinal dimension of the bit crown 103 can allow the drilling tool 100 to last longer and have a drilling life substantially equal to the reamer 104.

In particular, FIGS. 1 and 2 illustrates that the bit crown 103 can include a plurality of enclosed slots 114 that extend a distance from the cutting face 109 toward the shank 106 of the drilling tool 100. Additionally, the enclosed slots 114 can extend from the inner surface 116 of the bit crown 103 to the outer surface 118 of the bit crown 103. As waterways, the enclosed slots 114 can allow drilling fluid to flow from the inner surface 116 of the bit crown 103 to the outer surface 118 of the bit crown 103. Thus, the enclosed slots 114 can allow fluid to flush cuttings and debris from the inner surface 116 to the outer surface 118 of the drilling tool 100, and also provide cooling to the cutting face 109.

The bit crown 103 may have any number of enclosed slots 114 that provides the desired amount of fluid/debris flow or crown longitudinal dimension, while also allowing the bit crown 103 to have the desired drilling life while maintaining the structural integrity needed. For example, FIGS. 1 and 2 illustrate that the drilling tool 100 can include six enclosed slots 114. One will appreciate in light of the disclosure herein that the present invention is not so additional implementations, the drilling tool 100 can include no enclosed slots, one enclosed slot, or as many 20 or more enclosed slots, depending on the desired configuration and the formation to be drilled. Additionally, the enclosed slots 114 may be evenly or unevenly spaced around the circumference of the bit crown 103. For example, FIGS. 1 and 2 depict enclosed slots 114 evenly spaced from each other about the circumference of the bit crown 103. In alternative implementations, however, the enclosed slots 114 can be staggered or otherwise not evenly spaced.

The enclosed slots 114 and notches 112 can have any shape that allows them to operate as intended, and the shape can be altered depending upon the characteristics desired for the drilling tool 100 or the characteristics of the formation to be drilled. For example, the FIGS. 1 and 2 illustrate that the notches 112 and the enclosed slots 114 can have a trapezoidal shape. In alternative implementation, however, the notches 112 and the enclosed slots 114 can have square, triangular, circular, rectangular, polygonal, or elliptical shapes, or any combination thereof. Additionally, while the figures illustrate the notches 112 and the enclosed slots 114 have similar shapes, in alternative implementations the shape of the notches 112 may differ from the shape of the enclosed slots 114.

In addition to notches 112 and enclosed slots 114, the bit crown 103 can include additional features that can further aid in directing drilling fluid or other lubricants to the cutting face 109 or from the inside surface to the outside surface of the bit crown 103. For example, FIGS. 1-2 illustrate that the drilling tool 100 can include a plurality of flutes 122, 124 extending radially into the bit crown 103. In particular, in some implementations of the present invention the drilling tool 100 can include a plurality of inner flutes 122 that extend radially from the inner surface 116 toward the outer surface 118. The plurality of inner flutes 122 can help direct drilling fluid along the inner surface 116 of the drilling tool 100 from the shank 102 toward the cutting face 109. As shown in FIG. 1-2, in some implementations of the present invention the inner flutes 122 can extend from the shank 102 axially along the inner surface 116 of the bit crown 103 to the notches 112. Thus, the inner flutes 122 can help direct drilling fluid to the notches 112. In alternative implementations, the inner flutes 122 can extend from the shank 102 to the cutting face 109, or even along the shank 106.

FIGS. 1-2 additionally illustrate that in some implementations, the drilling tool 100 can include a plurality of outer flutes 124. The outer flutes 124 can extend radially from the outer surface 118 toward the inner surface 116 of the bit crown 103. The plurality of outer flutes 124 can help direct drilling fluid along the outer surface 118 of the drilling tool 100 from the notches 112 toward the shank 106. As shown in FIGS. 1-2, in some implementations of the present invention the outer flutes 124 can extend from the notches 112 axially along the outer surface 118 to the reamer 104.

Similar to the notches 112 and the enclosed slots 114, one or more implementations of a drilling tool 100 may not include inner flutes 122 or outer flutes 124. Alternatively, the drilling tool 100 may include inner flutes 122 but not outer flutes 124. In yet further implementations, the drilling tool 100 may include outer flutes 124 but not inner flutes 122.

As shown by FIG. 1, in one or more implementations, the integrated reamer 104 can include raised pads 130 separated by channels 132. The channels 132 can be aligned with the outer flutes 124 of the bit crown 103. Thus, the channels 132 can allow fluid to push cutting and debris from the outer flutes 124 away from the base of the bit crown 103. Thus, the integrated reamer 104 can reduce or prevent cutting and debris from wearing away the shank 106 at the base of the bit crown 103. In other words, the integrated reamer 104 can reduce or eliminate the parting of bit shanks in abrasive and broken conditions by providing increased flushing of cuttings away from the base of the bit crown 103.

As shown by FIG. 1, in one or more implementations the channels 132 can include a taper such that they increase in size as they extend away from the bit crown 103 toward the first end 105. The taper can act like a nozzle by increasing the velocity of the drilling fluid at the base of the bit crown 103 and provide for increased flushing of cuttings. In alternative implementations, the channels 132 may be linear and include no taper. In still further implementations, both sides of each channels 132 can include a taper.

Additionally, in one or more implementations the pads 130 can have a spiral configuration. In other words, the pads 130 can extend axially along the shank 106 and radially around the shank 106. The spiral configuration of the pads 130 can provide increased contact with the borehole, increased stability, and reduced vibrations. In alternative implementations, the pads 130 can have a linear instead of a spiral configuration. In such implementations, the pads 130 can extend axially along the shank 106. Furthermore, in one or more implementations the pads 130 can include a tapered leading edge to aid in moving the reamer 104 down the borehole.

As mentioned previously, the shank 106 can be configured to secure the drilling tool 100 to a drill string component, such as a core barrel. For example, the shank 106 can include an American Petroleum institute (API) threaded connection 108 portion or other features to aid in attachment to a drill string component. By way of example and not limitation, the shank portion 106 may be formed from steel, another iron-based alloy, or any other material that exhibits acceptable physical properties.

In some implementations of the present invention, the bit crown 103 of the tool 100 of the present invention can be made of one or more layers. For example, according to some implementations of the present invention, the bit crown 103 can include two layers. In particular, the bit crown 103 can include a matrix layer, which performs the drilling operation, and a backing layer, which connects the matrix layer to the shank 106. In these implementations, the matrix layer can contain the abrasive cutting media that abrades and erodes the material being drilled.

One will appreciate in light of the disclosure herein that the integrated reamer positioned 104 directly behind the bit crown 103 can reduce the necessary size of the backing layer and the amount of the backing powder used to form the backing layer. Furthermore, the integrated reamer 104 can reduce the amount of machining of the backing layer or shank 106 needed to extend the outer flutes 124 through the backing layer or into the shank 106.

In one or more implementations, the bit crown 103 can be formed from a matrix of hard particulate material, such as for example, a metal. One will appreciate in light of the disclosure herein, that the hard particular material may include a powered material, such as for example, a powered metal or alloy, as well as ceramic compounds. According to some implementations of the present invention the hard particulate material can include tungsten carbide. As used herein, the term "tungsten carbide" means any material composition that contains chemical compounds of tungsten and carbon, such as, for example, WC, W2C, and combinations of WC and W2C. Thus, tungsten carbide includes, for example, cast tungsten carbide, sintered tungsten carbide, and macrocrystalline tungsten. According to additional or alternative implementations of the present invention, the hard particulate material can include carbide, tungsten, iron, cobalt, and/or molybdenum and carbides, borides, alloys thereof, or any other suitable material.

As mentioned previously and as shown by FIG. 2, the bit crown 103 can also include a plurality of abrasive cutting media 140 dispersed throughout the hard particulate material. The abrasive cutting media can include one or more of natural diamonds, synthetic diamonds, polycrystalline diamond or thermally stable diamond products, aluminum oxide, silicon carbide, silicon nitride, tungsten carbide, cubic boron nitride, alumina, seeded or unseeded sol-gel alumina, or other suitable materials. In addition, FIG. 2 shows that the abrasive cutting media 140 can be dispersed throughout at least a portion of the bit crown 103 (i.e., the portion of the bit crown 103 between the cutting face 109 and the shank 106). In other words, the abrasive cutting media 140 can be embedded in within the bit crown 103 at the cutting face 109, as well as behind the cutting face 109.

The abrasive cutting media used in the drilling tools of one or more implementations of the present invention can have any desired characteristic or combination of characteristics. For instance, the abrasive cutting media can be of any size, shape, grain, quality, grit, concentration, etc. In some embodiments, the abrasive cutting media can be very small and substantially round in order to leave a smooth finish on the material being cut by the bit crown 103. In other embodiments, the cutting media can be larger to cut aggressively into the material or formation being drill.

The abrasive cutting media can be dispersed homogeneously or heterogeneously throughout the bit crown 103. As well, the abrasive cutting media can be aligned in a particular manner so that the drilling properties of the media are presented in an advantageous position with respect to the bit crown 103. Similarly, the abrasive cutting media can be contained in the bit crown 103 in a variety of densities as desired for a particular use. For example, large abrasive cutting media spaced further apart can cut material more quickly than small abrasive cutting media packed tightly together. Thus, one will appreciate in light of the disclosure herein that the size, density, and shape of the abrasive cutting media can be provided in a variety of combinations depending on desired cost and performance of the drilling tool 100.

For example, the bit crown 103 may be manufactured to any desired specification or given any desired characteristic (s). In this way, the bit crown 103 may be custom-engineered to possess optimal characteristics for drilling specific materials. For example, a hard, abrasion resistant matrix may be made to drill soft, abrasive, unconsolidated formations, while a soft ductile matrix may be made to drill an extremely hard, non-abrasive, consolidated formation. In this way, the matrix hardness may be matched to particular formations, allowing the matrix layer to erode at a controlled, desired rate and have a drilling substantially equal to the integrated reamer 104.

As the matrix erodes, new abrasive cutting media 140 can be continually exposed at the cutting face 109. Thus, the erosion of the matrix can provide a continuously sharp abrasive cutting media 140 at the cutting face 109 until the bit crown 103 is consumed. As alluded to earlier, in one or more implementations the composition of the bit crown 103 can be tailored to provide the bit crown 104 with a drilling life approximately equal to the drilling life of the reamer 104.

For example, the bit crown 104 can include a binder material. The binder can comprise copper, zinc, silver, molybdenum, nickel, cobalt, tin, manganese, silicon, iron, mixtures and alloys thereof, or other suitable materials. The binder material can bind the abrasive cutting media 140 and the matrix together. The binder material can be tailored for increased or decreased strength to tailor the ease with which the bit crown 104 will erode during drilling. In one or more implementations, the binder material can be tailored to provide the bit crown 103 with a drilling life approximately equal to the drilling life of the reamer 104.

Furthermore, in one or more implementations the bit crown 103 can optionally include a plurality of fibers 142 such as the fibers described in U.S. Pat. No. 7,695,542, the contents of which are hereby incorporated herein by reference in their entirety. In one or more implementations of the present invention, the fibers 142 can help control the rate at which the matrix erodes, and thus, the drilling life of the bit crown 103. Of course in alternative implementations, the bit crown 103 may not include fibers.

The fibers 142 can have varied shapes or combinations thereof, such as, for example, ribbon-like, cylindrical, polygonal, elliptical, straight, curved, curly, coiled, bent at angles, etc. The fibers 142 in the bit crown 103 of the impregnated drill bit 102 may be of any size or combination of sizes, including mixtures of different sizes. The size of the fibers 142 in the bit crown 103 can be tailored to control the erosion rate, and thus, drilling life of the bit crown 103. In one or more implementations, the size of the fibers 142 in the bit crown 103 can be tailored to provide the bit crown 103 with a drilling life approximately equal to the drilling life of the reamer 104.

The fibers 142 can include one or more of carbon fibers, metal fibers (e.g., fibers made of tungsten, tungsten carbide, iron, molybdenum, cobalt, or combinations thereof), glass fibers, polymeric fibers (e.g., fibers made of Kevlar), ceramic fibers (e.g., fibers made of silicon carbide), coated fibers, and/or the like. FIG. 2 illustrates that the fibers 142 can be dispersed at the cutting face 109 of the bit crown 103. In addition, FIG. 2 shows that the fibers 142 can be dispersed throughout at least a portion of the crown body (i.e., the portion of the bit crown 103 between the cutting face 109 and the shank 106). In other words, the fibers 142 can be embedded in within the bit crown 103 at the cutting face 109, as well as behind the cutting face 109.

The fibers 142 can be dispersed throughout at least a portion of the bit crown 103. For example, FIG. 2 illustrates that the fibers 142 are dispersed substantially entirely throughout the bit crown 103. In alternative implementations, the fibers 142 may be dispersed throughout only a portion of the bit crown 103. For instance, in some implementations the fibers 142 may be dispersed only in the portions of the bit crown 102 to thereby tailor the drilling life of the bit crown 103. In any event, the location of the fibers 142 in the bit crown 103 can be tailored to control the erosion rate, and thus, drilling life of the bit crown 103. In one or more implementations, the location of the fibers 142 in the bit crown 103 can be tailored to provide the bit crown 103 with a drilling life approximately equal to the drilling life of the reamer 104.

Figure 3:
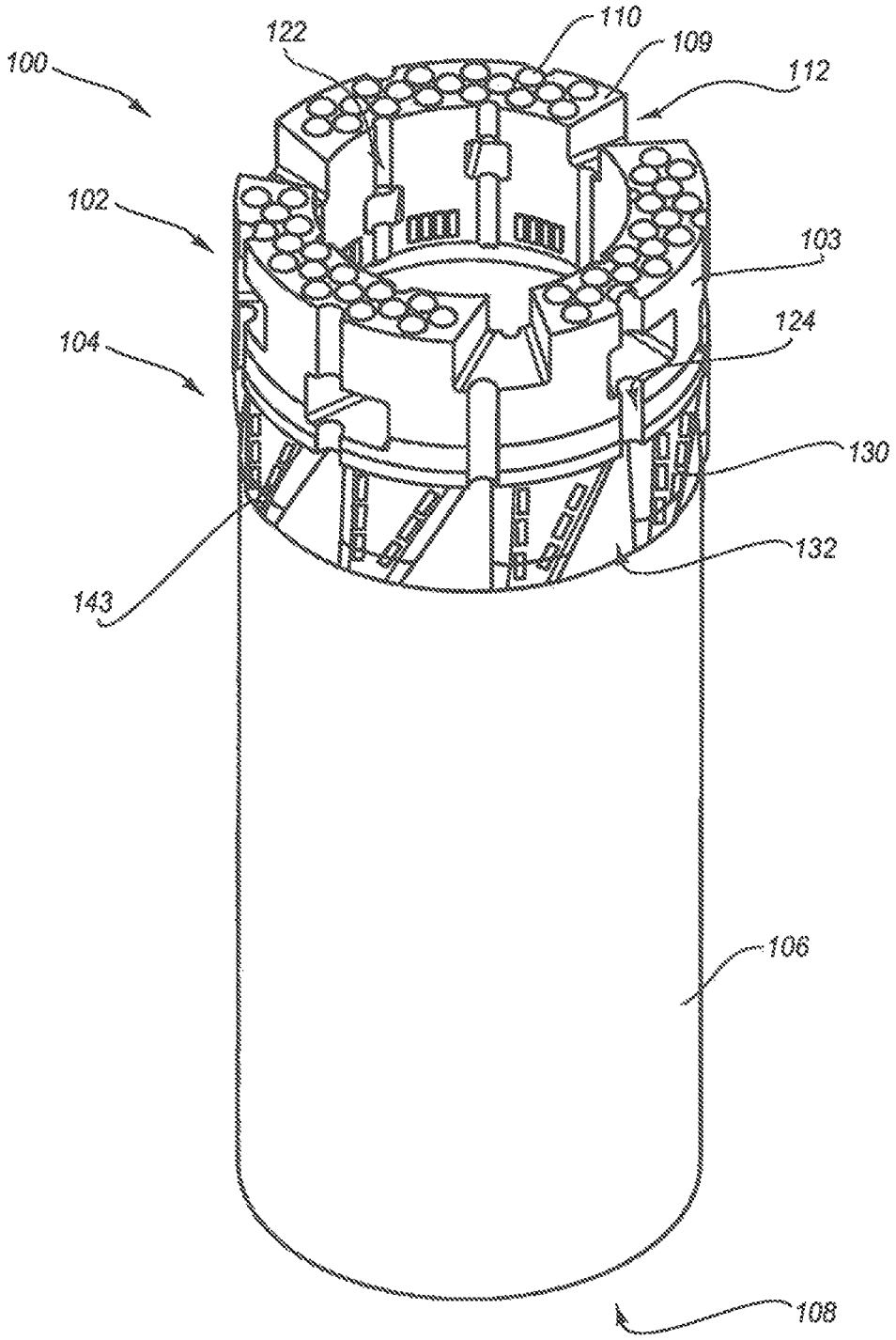
FIG. 3 illustrates a perspective view of the core drilling tool of FIG. 1 in which the reamer includes pins in accordance with an implementation of the present invention.

As shown in FIG. 3, the fibers 142 can be arranged in the bit crown 103 in an unorganized arrangement. In additional implementations, the fibers 142 can be randomly dispersed within the bit crown 103. Thus, in at least one implementation of the present invention, the fibers 142 are not arranged in specific alignments relative to each other or the cutting face 109.

In any event, as FIG. 2 illustrates, the fibers 142 may be dispersed homogeneously throughout the bit crown 103. In alternative implementations, the fibers 142 can be dispersed heterogeneously throughout the bit crown 103. For example, in some implementations, the concentration of the fibers 142 may vary throughout any portion of the bit crown 103, as desired to tailor the drilling life of the bit crown 103. In particular, the bit crown 103 can include a gradient of fibers 142. For instance, the portion of the bit crown 103 that is closest to the cutting face 109 of the impregnated drill bit 102 may contain a first concentration of fibers 142 and the concentration of fibers 142 can gradually decrease or increase towards the shank 106. In any event, the concentration of the fibers 142 in the bit crown 103 can be tailored to control the erosion rate, and thus, drilling life of the bit crown 103. In one or more implementations, the concentration of the fibers 142 in the bit crown 103 can be tailored to provide the bit crown 103 with a drilling life approximately equal to the drilling life of the reamer 104.

Similar to the bit crown 103, in some implementations the integrated reamer 104 can be formed from a matrix of hard particulate material, such as for example, a metal. One will appreciate in light of the disclosure herein, that the hard particular material of the reamer 104 may comprise any of the materials described herein above in relation to the hard particulate material of the bit crown 103. As shown in FIG. 2, the integrated reamer 104 can also include a plurality of abrasive cutting media 140 dispersed throughout the hard particulate material. The abrasive cutting media 140 of the reamer 104 can comprise any of the materials described herein above in relation to the abrasive cutting media 140 of the bit crown 103.

As shown by FIG. 3, alternatively, or additionally, the pads 130 of the integrated reamer 104 can include one or more pins 143. In one or more implementations, the pins 143 can be positioned along the leading and/or trailing edges of the pads 130. The pins 143 can be formed from tungsten carbide, thermally stable diamond or other abrasive material, such as those described herein above in relation to the abrasive cutting media. The pins 143 can help protect the gauge of the pads 130 and increase the cutting life of the integrated reamer 104. Thus, the number and placement of the pins 143 can be tailored to control the drilling life of the integrated reamer 104 such that the integrated reamer 104 has a drilling life substantially equal to the bit crown 104.

Figure 4:
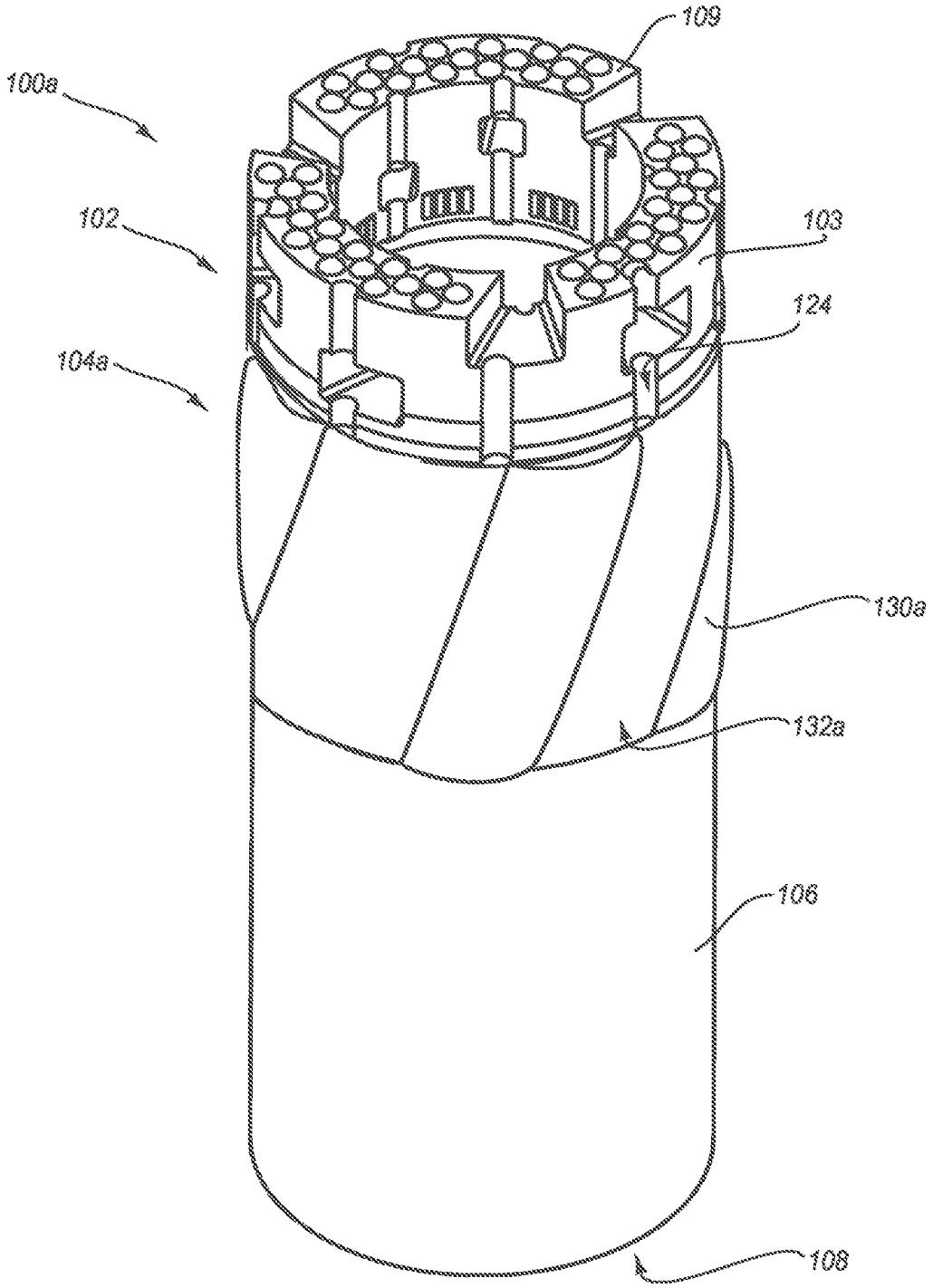
FIG. 4 illustrates a perspective view of a core drilling tool including an impregnated crown and an integrated reamer in accordance with another implementation of the present invention.

One will appreciate in light of the disclosure here that the integrated reamer 104 can include any number of different configurations. For example, FIG. 4 illustrates another implementation of drilling tool **100*a* with an integrated reamer 104*a* with an increased length. The drilling tool 100*a* can include a bit crown 103 and shank 106 similar to that of the drilling tool 100. As shown by FIG. 4, however, the integrated reamer 104*a* can have an increased length. The increased length of the integrated reamer 104 can provide increased stability and further help to stabilize the bit crown 103**.

Additionally, as shown by comparing FIGS. 1 and 4, the pads **130*a* and channels 132*a* of the integrated reamers of the present invention are not limited to any specific number, size, shape, or layout. Thus, FIG. 4 illustrates wider channels 132*a* that are connected to two outer flutes 124. The wider channels can help compensate for additional drag created by the increased length of the pads 130*a***.

Figure 5:
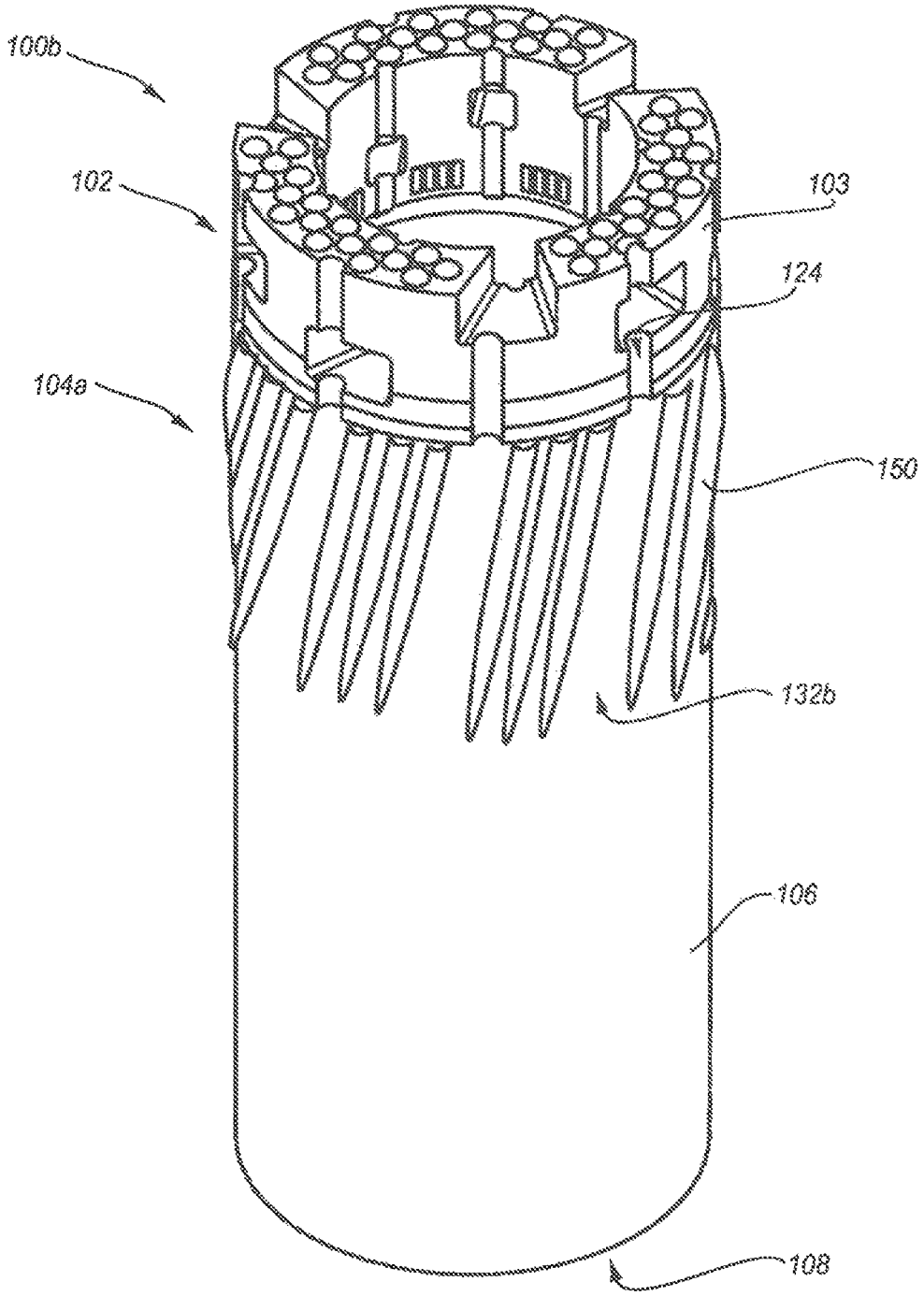
FIG. 5 illustrates a perspective view of a core drilling tool including an impregnated crown and an integrated reamer in accordance with yet another implementation of the present invention.

In some implementations, the integrated reamer 104 may not include pads 130. For example, FIG. 5 illustrates a drilling tool **100*b* including an integrated reamer 104*b* including broaches instead of pads. The broaches can include a plurality of strips 150. In some implementations, the strips 150 can be radiused and not fully hemispherical as shown in FIG. 5**. The broaches can reduce the contact of the integrated reamer on the borehole, thereby decreasing drag. Furthermore, the broaches can provide for increased water flow, and thus, may be particularly suited for softer formations.

Figure 6:
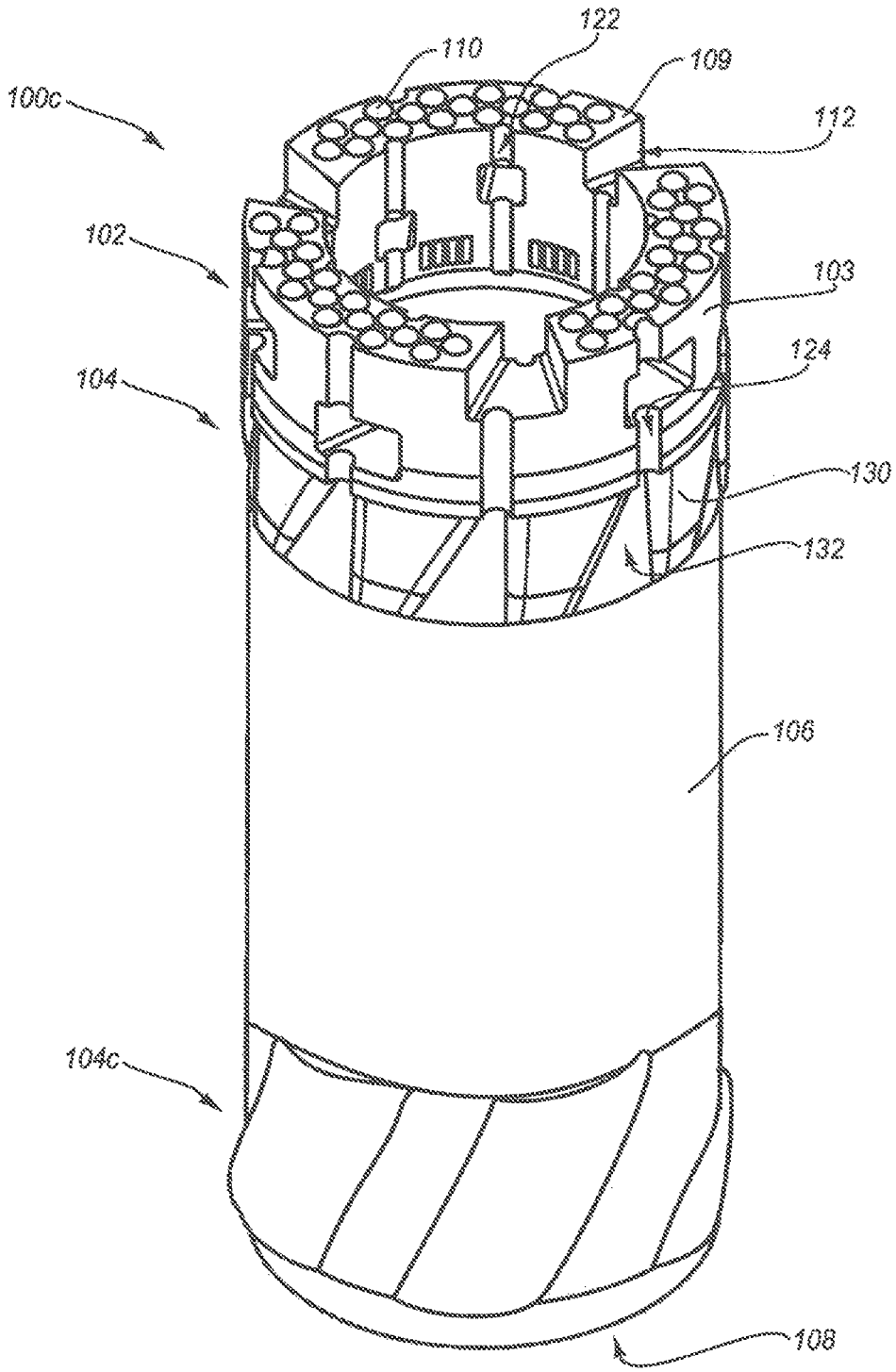
FIG. 6 illustrates a perspective view of a core drilling tool including an impregnated crown and an integrated reamer in accordance with still another implementation of the present invention.

The implementations of shown and described hereinabove have included a single integrated reamer. One will appreciate in light of the disclosure herein; however, that the present invention is not on limited. For example, FIG. 6 illustrates a drilling tool 100*c* including a first integrated reamer 104 positioned proximate the bit crown 103, and a second integrated reamer 104*c* positioned proximate the connector 108. The second integrated reamer 104*c* can provide additional stability to the drilling tool 100*c* and a drill string component secured to the connector 108. The second integrated reamer 104*c* can include a configuration similar to the first integrated reamer 104. Alternatively, FIG. 6 illustrates that the second integrated reamer 104*c* can differ from the first integrated reamer 104 in one or more of size, shape, length, abrasive material, or other configuration.

One will appreciate that the drilling tools with a tailored cutting portion according to implementations of the present invention can be used with almost any type of drilling system to perform various drilling operations. For example, FIG. 7, and the corresponding text, illustrate or describe one such drilling system with which drilling tools of the present invention can be used. One will appreciate, however, the drilling system shown and described in FIG. 7 is only one example of a system with which drilling tools of the present invention can be used.

Figure 7:
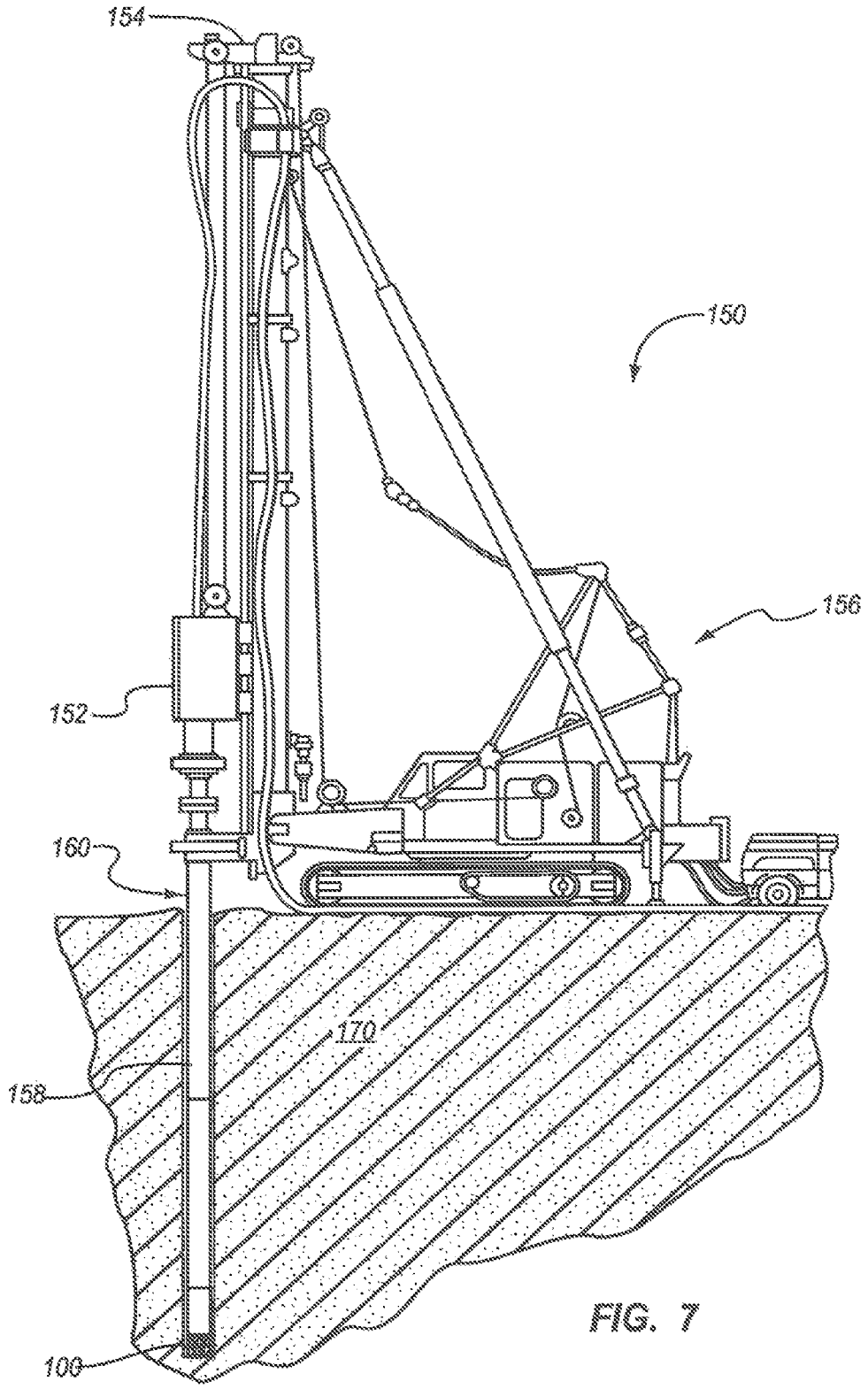
FIG. 7 illustrates a schematic view a drilling system including a drilling tool including an impregnated crown and an integrated reamer in accordance with an implementation of the present invention.

For example, FIG. 7 illustrates a drilling system 150 that includes a drill head 152. The drill head 152 can be coupled to a mast 154 that in turn is coupled to a drill rig 156. The drill head 152 can be configured to have one or more tubular members 158 coupled thereto. Tubular members can include, without limitation, drill rods, casings, and down-the-hole hammers. For ease of reference, the tubular members 158 will be described herein after as drill string components. The drill string component 158 can in turn be coupled to additional drill string components 158 to form a drill or tool string 160. In turn, the drill string 160 can be coupled to drilling tool 100 including a drill bit 102 and an integrated reamer 104, such as the drilling tools 100, 100*b*, 100*c* described hereinabove. As alluded to previously, the drilling tool 100 can be configured to interface with the material 170, or formation, to be drilled.

In at least one example, the drill head 152 illustrated in FIG. 7 can be configured rotate the drill string 160 during a drilling process. In particular, the drill head 152 can vary the speed at which the drill head 152 rotates. For instance, the rotational rate of the drill head and/or the torque the drill head 152 transmits to the drill string 160 can be selected as desired according to the drilling process.

Furthermore, the drilling system 150 can be configured to apply a generally longitudinal downward force to the drill string 160 to urge the drilling tool 100 into the formation 170 during a drilling operation. For example, the drilling system 150 can include a chain-drive assembly that is configured to move a sled assembly relative to the mast 154 to apply the generally longitudinal force to the drilling tool 100 as described above.

As used herein the term "longitudinal" means along the length of the drill string 160. Additionally, as used herein the terms "upper," "top," and "above" and "lower" and "below" refer to longitudinal positions on the drill string 160. The terms "upper," "top," and "above" refer to positions nearer the drill head 152 and "lower" and "below" refer to positions nearer the drilling tool 100.

Thus, one will appreciate in light of the disclosure herein, that the drilling tools of the present invention can be used for any purpose known in the art. For example, a drilling tool 100 can be attached to the end of the drill string 160, which is in turn connected to a drilling machine or rig 156. As the drill string 160 and therefore the drilling tool 100 are rotated and pushed by the drilling machine 156, the drill bit 100 can grind away the materials in the subterranean formations 170 that are being drilled. The core samples that are drilled away can be withdrawn from the drill string 160. The bit crown 103 and the reamer 104 of the drilling tool 100 can erode over time because of the grinding action. This process can continue until the cutting portion of a bit crown 103 and the reamer 104 have been consumed and the drilling string 160 can then be tripped out of the borehole and the drilling tool 100 replaced. In one or more implementations, the bit crown 103 and the reamer 104 can be configured to be consumed or otherwise require replacement at approximately the same time.

Implementations of the present invention also include methods of forming drilling tools having an integrated reamer. The following describes at least one method of forming drilling tools 100, 100*a*, 100*b*, 100*c* having an integrated reamer 104, 104*a*, 104*b*, 104*c*. Of course, as a preliminary matter, one of ordinary skill in the art will recognize that the methods explained in detail can be modified to install a wide variety of configurations using one or more components of the present invention.

As an initial matter, the term "infiltration" or "infiltrating" as used herein involves melting a binder material and causing the molten binder to penetrate into and fill the spaces or pores of a matrix. Upon cooling, the binder can solidify, binding the particles of the matrix together. The term "sintering" as used herein means the removal of at least a portion of the pores between the particles (which can be accompanied by shrinkage) combined with coalescence and bonding between adjacent particles.

One method of the present invention can include forming a bit crown 103. Forming a bit crown 103 can include providing a matrix of hard particulate material and abrasive cutting media 104, such as the previously described hard particulate materials and abrasive cutting media materials. In some implementations of the present invention, the hard particulate material can comprise a power mixture. The method can also involve pressing or otherwise shaping the matrix into a desired form. For example, the method can involve forming the matrix into the shape of an annular bit crown 103. In one or more further implementations, the method can further include dispersing a plurality of fibers 142 throughout at least a portion of the matrix. In particular, the method can include dispersing fibers randomly or in an unorganized arrangement throughout the matrix.

The method can then infiltrating the matrix with a binder. The binder can comprise copper, zinc, silver, molybdenum, nickel, cobalt, tin, manganese, silicon, iron, mixtures and alloys thereof, or other suitable materials. The binder can cool thereby bonding to the matrix (hard particulate material and abrasive cutting media), thereby binding the matrix together.

Another, method of the present invention generally includes forming a bit crown 103 by providing a matrix and filling a mold with the matrix. The mold can be formed from a material to which a binder material may not significantly bond to, such as for example, graphite or carbon. The method can then involve densification of the matrix by gravity and/or vibration. The method can then involve infiltrating matrix with a binder comprising one or more of the materials previously mentioned. The binder can cool thereby bonding to the matrix (hard particulate material and abrasive cutting media), thereby binding the matrix together.

Before, after, or in tandem with the infiltration of the matrix, one or more methods of the present invention can include sintering the matrix to a desired density. As sintering involves densification and removal of porosity within a structure, the structure being sintered can shrink during the sintering process. A structure can experience linear shrinkage of between 1% and 40% during sintering. As a result, it may be desirable to consider and account for dimensional shrinkage when designing tooling (molds, dies, etc.) or machining features in structures that are less than fully sintered.

According to some implementations of the present invention, the time and/or temperature of the infiltration process can be increased to allow the binder to fill-up a great number and greater amount of the pores of the matrix. This can both reduce the shrinkage during sintering, and increase the strength of the resulting drilling tool.

The method can involve securing the bit crown 103 to the shank 106. In particular, in one or more implementations a backing layer may be used to secure the bit crown 103 to the shank 106. Once the bit crown 103 has been secured to the shank 106, or before, or at the same time, the method can involve securing a reamer 104, 104*a*, 104*b*, 104*c* to the shank 106. In one or more implementations, the reamer 104, 104*a*, 104*b*, 104*c* can be cast onto the shank 106. Alternatively, depending upon the composition of the reamer 104, 104*a*, 104*b*, 104*c*, the reamer 104, 104*a*, 104*b*, 104*c* may be fused or welded to the shank 106. In still further implementations, the bit crown 103 and the reamer 104, 104*a*, 104*b*, 104*c* can be secured to the shank 106 in a single furnace step.

In addition to the foregoing, implementations of the present invention also include methods of drilling using drilling tools having an integrated reamer. The following describes at least one method of core drilling using one or more drilling tools 100, 100*a*, 100*b*, 100*c* described hereinabove. Of course, as a preliminary matter, one of ordinary skill in the art will recognize that the methods explained in detail can be modified to install a wide variety of configurations using one or more components of the present invention.

For example, a method of core drilling can involve securing a first end 105 of a unitary drilling tool 100, 100*a*, 100*b*, 100*c* to a drill string 160. For example, the method can involve threading a connector 108 onto a drills string 160. The method can also involve advancing the drill string 160 into a formation 170 whereby a bit crown 130 on the second end of the unitary drilling tool 100, 100*a*, 100*b*, 100*c* can cut a hole into the formation 170. Additionally, a reamer 104, 104*a*, 104*b*, 104*c* on the unitary drilling tool 100, 100*a*, 100*b*, 100*c* can maintain a diameter of the hole. The method can further include retrieving a core sample from the drill string 160 using a wireline.

The method can also involve tripping the drill string 160 from the formation 170 when the bit crown 103 and the reamer 104, 104*a*, 104*b*, 104*c* are consumed. As discussed herein above, the bit crown 103 can wears away during drilling such that a drilling life of the bit crown 103 and a drilling life of the reamer 104, 104*a*, 104*b*, 104*c* are approximately equal. The method can further involve removing the unitary drilling tool 100, 100*a*, 100*b*, 100*c* from the drill string 160 by breaking a single joint between the first end 105 of the unitary drilling tool 100, 100*a*, 100, 100*c* and the drill string 160.

The present invention can thus be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A drilling tool comprising:

a unitary shank having a first end and an opposing second end;

a connector on the first end of the shank that is configured for securing the shank to a drill string component;

a drill hit having a hit crown secured to the second end of the shank; and a reamer positioned along the shank between the connector and the bit crown, wherein the reamer and the drill bit comprise a single component that is infiltrated as one piece, and wherein a height of the bit crown is tailored to provide it crown with a drilling life approximately equal to a drilling life of the reamer.

2. The drilling tool as recited in claim 1, wherein the bit crown is impregnated with abrasive cutting media.

3. The drilling tool as recited in claim 1, wherein the top portion of the reamer is integrally coupled to a base of the bit crown.

4. The drilling tool as recited in claim 1, wherein the reamer is a first reamer, and wherein the drilling tool further comprises a second reamer secured on the shank proximate the connector.

5. The drilling tool as recited in claim 4, wherein the second reamer comprises the same material as one or more of the bit crown and the first reamer.

6. The drilling tool as recited in claim 1, further comprising outer flutes extending along an outer surface of the bit crown.

7. The drilling tool as recited in claim 6, wherein the reamer comprises pads separated by channels, and wherein the channels comprise a taper such that the channels increase in width as they extend away from the bit crown.

8. The drilling tool as recited in claim 7, wherein the channels are aligned with the outer flutes.

9. The drilling tool as recited in claim 1, wherein the drill bit comprises a core-drill bit.

10. The drilling tool as recited in claim 1, the bit crown comprising:

a matrix; and a plurality of abrasive cutting media dispersed within the matrix;

wherein the matrix is adapted to wear away to continuously expose abrasive cutting media.

11. The drilling tool as recited in claim 10, wherein the reamer comprises a second matrix of hard particulate material and a plurality of abrasive cutting media dispersed throughout the hard particulate material of the second matrix.

12. A core drilling system comprising:

a drill string;

a drilling tool secured to a distal end of the drill string, the drilling tool comprising:

a unitary shank having a first end and a second opposing end, wherein the first end of the shank is configured to be threadably secured to the distal end of the drill string, a drill bit comprising an annular bit crown secured to the second end of the shank, and a reamer positioned along the shank between the connector and the bit crown, wherein the reamer and the drill bit comprise a single component that is infiltrated as one piece, and wherein a height of the bit crown is tailored to provide the bit crown with a drilling life approximately equal to a drilling life of the reamer.

13. The core drilling system as recited in claim 12, the bit crown comprising:

a matrix; and a plurality of abrasive cutting media dispersed within the matrix;

wherein the matrix is adapted to wear away to continuously expose abrasive cutting media.

14. The core drilling system as recited in claim 13, wherein the reamer comprises a second matrix of hard particulate material and a plurality of abrasive cutting media dispersed throughout the hard particulate material of the second matrix.

15. The core drilling system as recited in claim 13, further comprising a plurality of fibers dispersed within the matrix, wherein one or more of a size and a concentration of the fibers cooperate with the height of the bit crown to provide the bit crown with a drilling life approximately equal to the cutting life of the reamer.

16. The core drilling system as recited in claim 12, further comprising outer flutes extending along an outer surface of the bit crown.

17. The core drilling system as recited in claim 16, wherein the reamer comprises pads separated by channels.

18. The core drilling system as recited in claim 17, wherein the channels comprise a taper such that the channels increase in width as they extend away from the bit crown.

19. The core drilling system as recited in claim 17, wherein the channels are aligned with the outer flutes.

20. The core drilling system as recited in claim 12, wherein the drilling tool has an elongate length about 6 times the elongate height of the bit crown.

21. The core drilling system as recited in claim 12, wherein the reamer is a first reamer, and wherein the drilling tool further comprises a second reamer secured on the shank proximate the connector.

22. The core drilling system as recited in claim 21, wherein the second reamer comprises the same material as one or more of the bit crown and the first reamer.

23. A method of core drilling, comprising:

securing a first end of a unitary drilling tool to a drill string, wherein the unitary drilling tool comprises:

a unitary shank having a first end and a second opposing end, wherein the first end of the shank is configured to be threadably secured to the distal end of the drill string, a drill bit comprising an annular bit crown secured to the second end of the shank, and a reamer secured to the shank between the first and second ends of the shank, wherein the reamer and the drill bit comprise a single component that is infiltrated as one piece;

advancing the drill string into a formation whereby the bit crown on the second end of the unitary drilling tool cuts a hole into the formation and whereby the reamer on the unitary drilling tool maintains a diameter of the hole;

tripping the drill string from the formation; and removing the unitary drilling tool from the drill string by breaking a single joint between the first end of the unitary drilling tool and the drill string.

24. The method of core drilling as recited in claim 23, further comprising retrieving a core sample from the drill string using a wireline.

25. The method of core drilling as recited in claim 23, wherein the reamer comprises a first matrix of hard particulate material and a plurality of abrasive cutting media dispersed throughout the hard particulate material of the first matrix, and wherein the bit crown comprises a second matrix of hard particulate material and a plurality of abrasive cutting media dispersed throughout the hard particulate material of the second matrix.

26. The method of core drilling as recited in claim 23, wherein a height of the bit crown is tailored to provide the bit crown with a drilling life approximately equal to a drilling life of the reamer.

* * * * *